US012434088B2

(12) United States Patent
Vad

(10) Patent No.: US 12,434,088 B2
(45) Date of Patent: Oct. 7, 2025

(54) FITNESS DEVICE

(71) Applicant: Christoph Vad, Munich (DE)

(72) Inventor: Christoph Vad, Munich (DE)

(73) Assignee: Christoph VAD, Munich (DE)

( * ) Notice: Subject to any disclaimer, the term of this patent is extended or adjusted under 35 U.S.C. 154(b) by 63 days.

(21) Appl. No.: 18/011,524

(22) PCT Filed: Jun. 17, 2021

(86) PCT No.: PCT/IB2021/055367
§ 371 (c)(1),
(2) Date: Dec. 20, 2022

(87) PCT Pub. No.: WO2021/255686
PCT Pub. Date: Dec. 23, 2021

(65) Prior Publication Data

US 2023/0277888 A1 Sep. 7, 2023

(30) Foreign Application Priority Data

Jun. 17, 2020 (DE) ..... 10 2020 115 986.2

(51) Int. Cl.
*A63B 21/005* (2006.01)
*A63B 21/00* (2006.01)
(Continued)

(52) U.S. Cl.
CPC ..... *A63B 21/0053* (2013.01); *A63B 21/0628* (2015.10); *A63B 21/151* (2013.01);
(Continued)

(58) Field of Classification Search
CPC ..... A63B 21/0053; A63B 21/0628; A63B 21/151; A63B 21/157; A63B 21/225; A63B 69/16; A63B 2069/165; A63B 23/085; A63B 22/0605; A63B 23/0476; A63B 23/0494; A63B 2022/0079;
(Continued)

(56) References Cited

U.S. PATENT DOCUMENTS 3,452,984 A * 7/1969 Harbaugh ..... A63B 63/083 473/482
3,995,853 A * 12/1976 Deluty ..... A63B 21/00069 482/123

(Continued)

FOREIGN PATENT DOCUMENTS

EP 3291891 A1 3/2018

OTHER PUBLICATIONS

International Search Report of PCT/IB2021/055367.
Written Opinion of PCT/IB2021/055367.

*Primary Examiner* — Garrett K Atkinson

(57) ABSTRACT

The disclosure relates to a cable tensioning station for providing a defined resistance force for resistance training, including a weight (9), which is arranged movably above a pull element (7, 17) and on which the resistance force is at least dependent, the pull element (7, 17) being guided via at least one coupling roller (18), which is designed to transfer a linear motion of the pull element as a rotary motion to a generator (19) to generate electrical energy, characterised in that the coupling roller (18) is embodied as a freewheel with adjustable blocking effect.

14 Claims, 10 Drawing Sheets

(51) Int. Cl.
*A63B 21/062* (2006.01)
*A63B 21/22* (2006.01)
*A63B 69/16* (2006.01)

(52) U.S. Cl.
CPC ..... *A63B 21/157* (2013.01); *A63B 21/225* (2013.01); *A63B 69/16* (2013.01); *A63B 2069/165* (2013.01)

(58) Field of Classification Search
CPC ..... A63B 2071/009; A63B 21/0055; A63B 21/023; A63B 21/4043; A63B 21/153; A63B 24/0087; A63B 2023/0411
See application file for complete search history.

(56) References Cited

U.S. PATENT DOCUMENTS 4,114,874 A * 9/1978 Mattila ..... A63B 21/00069 254/374
4,114,875 A * 9/1978 Deluty ..... A63B 21/018 188/65.1
4,529,195 A * 7/1985 Stevens ..... A63B 5/20 482/4
4,603,855 A * 8/1986 Sebelle ..... A63B 21/06 482/133
4,678,184 A * 7/1987 Neiger ..... A63B 21/153 482/4
4,709,918 A * 12/1987 Grinblat ..... A63B 22/203 482/118
4,844,450 A * 7/1989 Rodgers, Jr. ..... A61H 1/0244 434/254
5,007,631 A * 4/1991 Wang ..... A63B 23/03583 482/52
5,042,798 A * 8/1991 Sawicky ..... A63B 21/157 482/73
5,090,694 A * 2/1992 Pauls ..... A63B 21/015 482/904
5,158,513 A * 10/1992 Reeves ..... A63B 69/10 434/254
5,292,293 A * 3/1994 Schumacher ..... A63B 24/00 482/4
5,302,161 A * 4/1994 Loubert ..... A63B 21/157 482/99
5,378,214 A * 1/1995 Kreitenberg ..... A63B 22/0605 482/57
5,409,435 A * 4/1995 Daniels ..... F16D 57/002 482/901
5,595,554 A * 1/1997 Maresh ..... A63B 21/157 482/52
5,749,807 A * 5/1998 Webb ..... A63B 21/00076 482/52
8,894,547 B2 * 11/2014 Bruno ..... A63B 23/1209 482/901
10,143,880 B1 * 12/2018 Boatwright ..... A63B 21/078
2002/0091007 A1 * 7/2002 Hollrock ..... A63B 57/0006 473/132
2003/0203796 A1 * 10/2003 Yu ..... A63B 21/0628 482/99
2004/0072657 A1 * 4/2004 Arguilez ..... A63B 69/16 482/61
2004/0229705 A1 * 11/2004 Hollrock ..... A63B 57/0006 473/137
2008/0254943 A1 * 10/2008 Lin ..... A63B 21/0051 492/8
2010/0289246 A1 * 11/2010 Williams ..... B62K 3/02 280/281.1
2011/0251020 A1 * 10/2011 Caragio ..... A63B 21/4049 482/57
2012/0241700 A1 * 9/2012 Mauthner ..... A62B 1/14 254/391
2013/0337981 A1 * 12/2013 Habing ..... A63B 21/0618 482/110
2017/0361153 A1 * 12/2017 Machovina ..... A63B 21/153
2018/0326255 A1 * 11/2018 Schranz ..... A63B 21/08
2019/0134449 A1 * 5/2019 Yeh ..... A63B 23/1209
2019/0366148 A1 * 12/2019 Hsu ..... A63B 1/00
2020/0179749 A1 * 6/2020 Lindström ..... A63B 22/208
2020/0269084 A1 * 8/2020 Rorie ..... A63B 23/1245
2021/0244995 A1 * 8/2021 Andrei ..... A63B 21/0051
2022/0409953 A1 * 12/2022 Schranz ..... A63B 21/065
2023/0116715 A1 * 4/2023 Powell ..... A63B 21/00072 482/110
2024/0173588 A1 * 5/2024 Lee ..... A63B 21/153

* cited by examiner

FITNESS DEVICE

CROSS-REFERENCE TO RELATED APPLICATIONS

This Application is a national stage application of PCT/162021/055367. This application claims priorities from PCT Application No. PCT/162021/055367, filed Jun. 17, 2021, and from the German patent application 10 2020 115 986.2 filed Jun. 17, 2020, the content of which are incorporated herein in the entirety by reference.

TECHNICAL FIELD

The disclosure relates to a cable pull station pursuant to the preamble of the valid claim 1.

BACKGROUND

State of the Art

A cable pull station pursuant to the preamble of the valid claim 1 is known from DE 202013010116 U1.

Cable pull stations are multifunctional fitness machines that come in many different shapes and variations. Some machines are more suitable for strength training, others for performance training. The difference is that with strength training machines only the number of repetitions and the amount of weight resistance can be easily measured. However, the distance travelled during the exercise and the time elapsed cannot be easily measured and therefore the training performance cannot be measured either.

Other types of fitness machines, colloquially also known as cardio machines, can measure physical performance, but they do not work with constant weight resistance, but with dynamic resistances to rotation. With these machines, training performance can be measured, but the resistances to be overcome are not constant and therefore rather unsuitable for strength training.

A fundamental deficit of stationary fitness machines is also that the training performance can usually not be further utilized energetically and the only purpose of the physical energy expenditure is to provide the body with a training stimulus by repeatedly overcoming resistances.

Although there are fitness machines, such as stationary bicycles or rowing machines, on which power can be measured and converted into electrical energy, the training possibilities are limited to a few, fixed movement sequences and thus the cost/benefit ratio is not optimal.

A sensible development would therefore be a fitness machine on which it is possible to train with both static and dynamic resistance, which enables both isolation exercises and basic exercises for the entire musculoskeletal system and which can also efficiently convert the physical work performed on it into electrical energy, thus enabling the training performance to be measured and further utilized.

SUMMARY

It is the object of the disclosure to specify a stationary cable pull machine which overcomes the aforementioned disadvantages and offers everyone interested in physical exercise the possibility of performing physical work in a healthy and varied manner on a machine and to be able to measure, evaluate and further utilize this optionally in the form of electrical energy.

The task is fulfilled by the characteristics of the independent claim 1. Preferred embodiments of the disclosure are the subject matter of the dependent claims.

The disclosure is realized in a fitness machine in the form of a cable pull machine, comprising a rope pull station and a generator module with an adjustable clamping roller coupling and being designed in such a way that it can be used to train with both static and dynamic resistances and that the mechanical energy generated by muscle power in many ways can be converted, directly or indirectly, into electrical energy and thus the training performance achieved can be measured and further utilized.

BRIEF DESCRIPTION OF THE DRAWINGS

The above-described properties, features and advantages of this disclosure, as well as the manner in which they are achieved, will become clearer in connection with the following description of the embodiments, which are explained in more detail in connection with the drawing, in which.

DETAILED DESCRIPTION

In the figures, the same technical elements are provided with the same reference signs, and are only described once. The figures are purely schematic and, in particular, do not reflect the actual geometric proportions.

Figure 1:
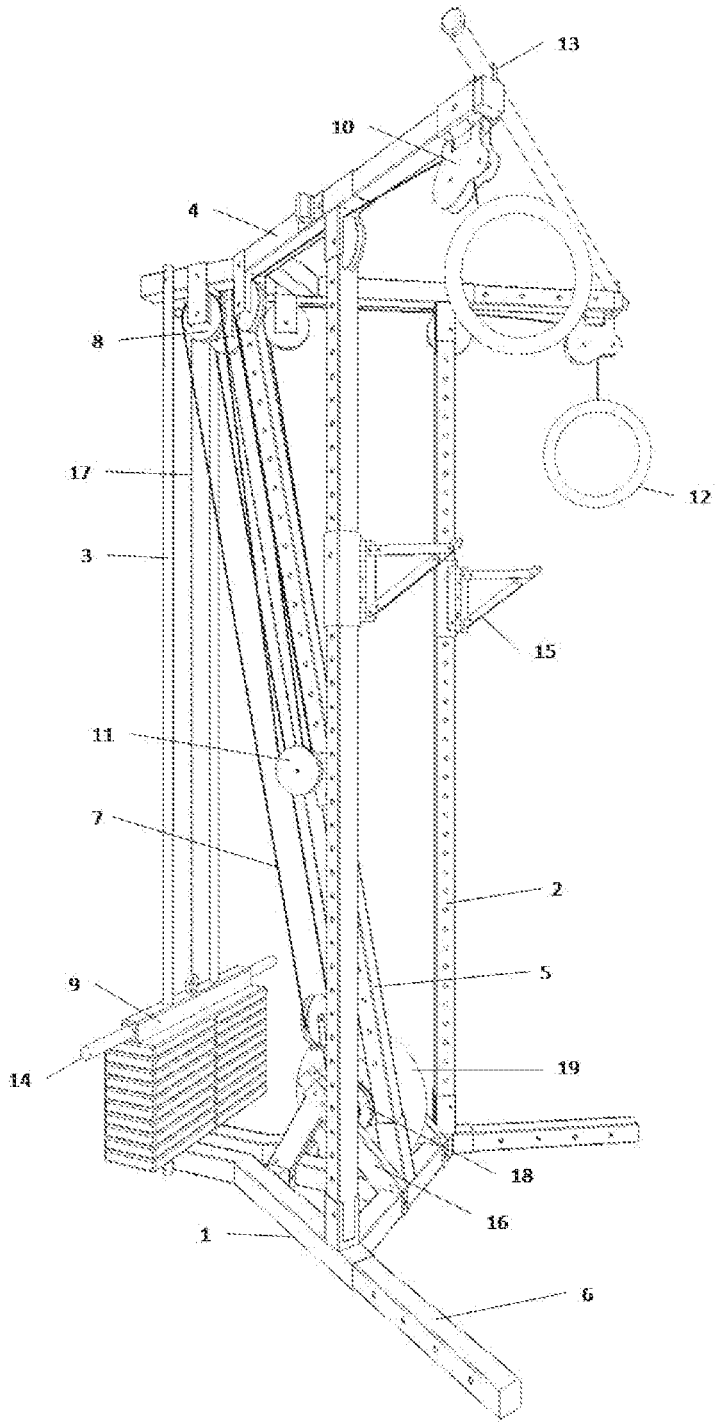
FIG. 1 shows a fitness machine in the form of a cable pull machine in a first perspective view.
Figure 2:
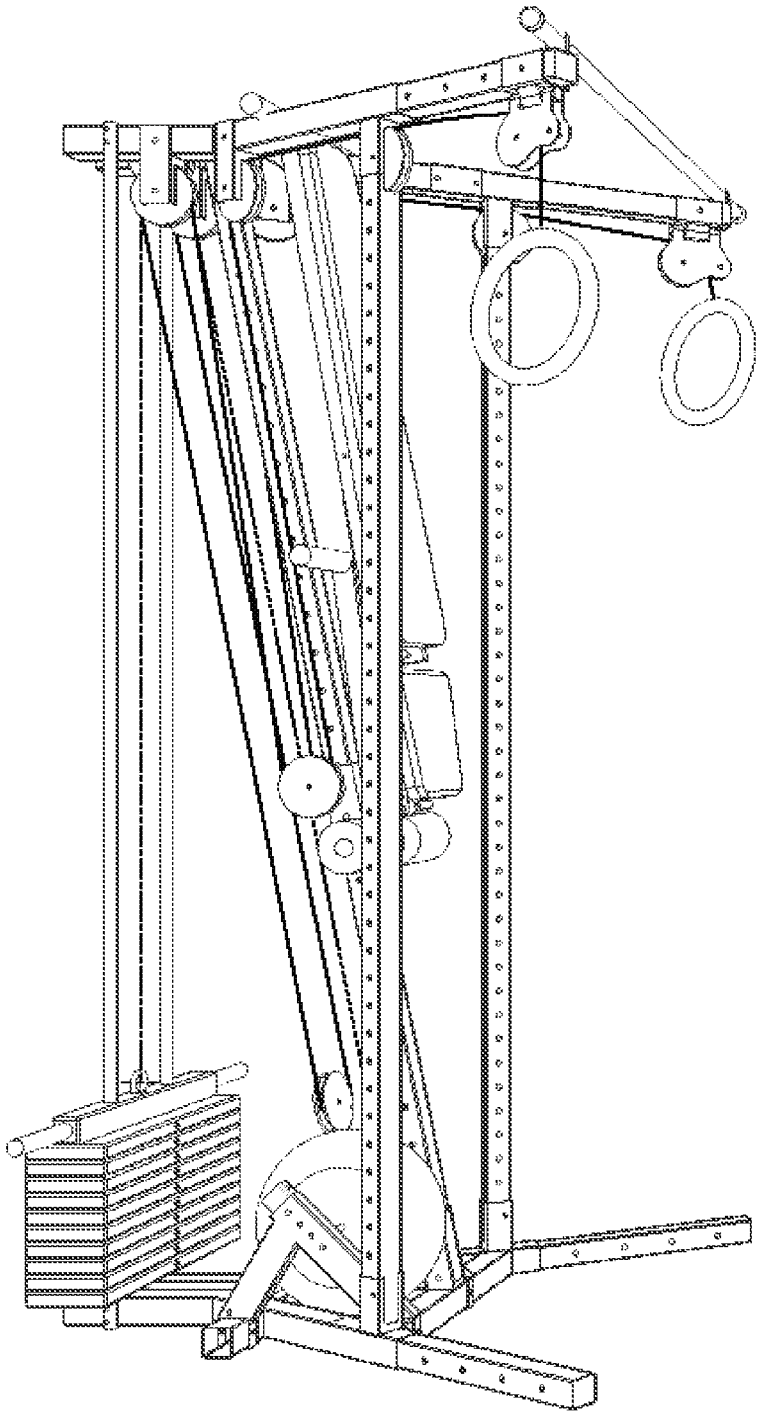
FIG. 2 shows the cable pull machine of FIG. 1 in a second perspective view.

Reference is made to FIG. 1, which shows a fitness machine in the form of a cable pull machine, also called rope pull station, with the following structure:

The basic frame of the rope pull station comprises a welded foot construction (1), to which two front supports (2) and two rear weight guide rods (3) are mounted vertically, to which in turn a welded head construction (4) is attached.

An inclined support (5) is mounted between the front foot and rear head construction, which braces the frame. Two horizontally extendable cantilever arms (6) each protrude from the foot and head construction and can be locked in different extension positions by means of plug or screw connections.

By diverting a wire rope or cable (7) via ball-bearing rope pulleys (8) arranged at specific points on the frame construction, a weight block (9) can be lifted vertically along the two weight guide rods.

The wire rope is diverted by means of the pulleys in such a way that one end of each wire rope ends at the upper end of the two vertical supports and is guided from there further over one swiveling, freely adjustable rope pulley (8) each.

The two swiveling, freely adjustable rope pulleys (10) can be fixed on their respective side along the vertical support and along the cantilever arms at regular intervals by means of plug-in systems.

The free lengths of the two rope ends can be adjusted by deflecting the rope via an additional pair of pulleys (11), which can be adjusted along the inclined central support by means of a plug-in system.

A special feature of this rope pull station is that with the help of the cantilever arms, which extend out of the head and foot construction in a v-shape manner, the operable rope pull ends can be adjusted and deflected via the swiveling rope pulleys, unlike with conventional wire rope hoists, not only along the vertical supports, but also laterally along the standing surface and over the head of the person working out. The versatile adjustability of the two operable wire rope hoist ends, which can be provided with different handle grips (12), allows a variety of different rope pull exercises, in particular also barbell exercises such as bench press, deadlift, squat, snatch or push exercises directly on the wire rope hoist.

Another special feature of the rope pull station is that the two cantilever arms of the head structure have two fork bearings (13) into which a barbell, or other grip or hanging devices, can be clamped, thus enabling various bar exercises.

The weight block also has a linkage for holding additional weight plates (14), which means that the weight load can be finely regulated and extended by means of additional weight plates.

Another special feature of this rope pull station are the two swiveling, adjustable support devices (15), which can be attached to the vertical front supports by means of a plug-in system if necessary and can serve as dumbbell rests for barbell exercises, as support spars for supporting or hanging exercises, or also as climbing steps.

Due to the fact that the support devices can be swiveled, the support width can be adjusted as required.

The foot construction with the v-shaped extendable cantilever arms enables the use of ordinary flat, inclined and folding benches at the rope pull station.

Ideally, an adjustable, collapsible training bench is used, which can be connected to the inclined central support by means of a plug-in system if required, and which can be suspended from the head construction in a space-saving and secure manner when not in use, without this leading to a restriction in the operability of the rope pull station.

Another special feature of this rope pull station is that a generator module with adjustable clamping roller coupling can be mounted on the frame of the rope pull station in such a way that a power transmission can be established between the wire rope hoist and a generator.

The fitness machine of FIG. 1 further comprises the generator module with adjustable clamping roller coupling:

The generator module can be mounted to the frame construction of the rope pull station by means of its stand construction (16).

By extending the wire rope hoist of the rope pull station with a rope-chain segment (17), the wire rope hoist can be deflected via the chain ring of the adjustable clamping roller coupling (18), thus creating a frictional connection.

With the aid of the adjustable clamping roller coupling, a power transmission between the wire rope hoist and the generator module can be adjusted so that the energy acting in the wire rope hoist is converted into a torque and transmitted to the hub generator (19) (HG) to drive the rotor.

By driving the rotor, an electrical voltage is induced in the hub generator and, by connecting a consumer or an energy storage device, the energy physically applied at the rope pull station can thus be converted into electrical energy.

Figure 5:
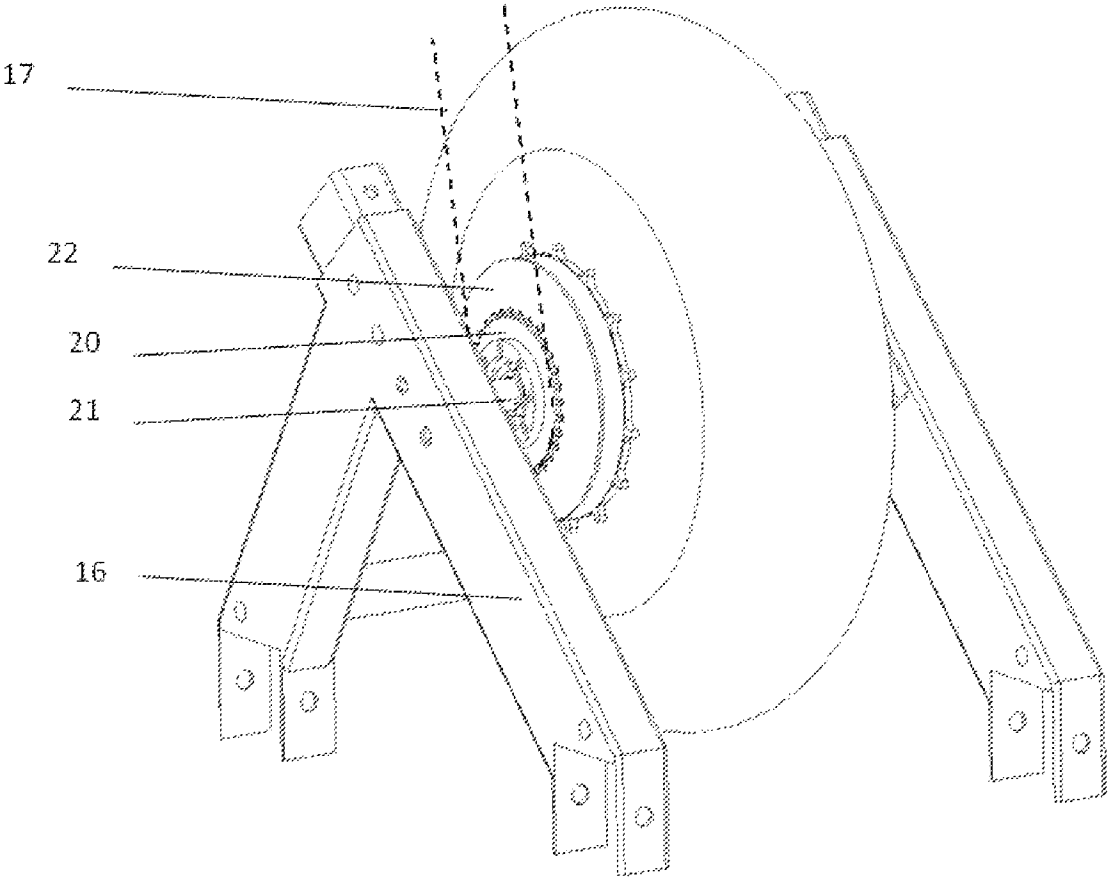
FIG. 5 shows a generator in the cable pull machine of FIG. 1 in a perspective view.
Figure 6:
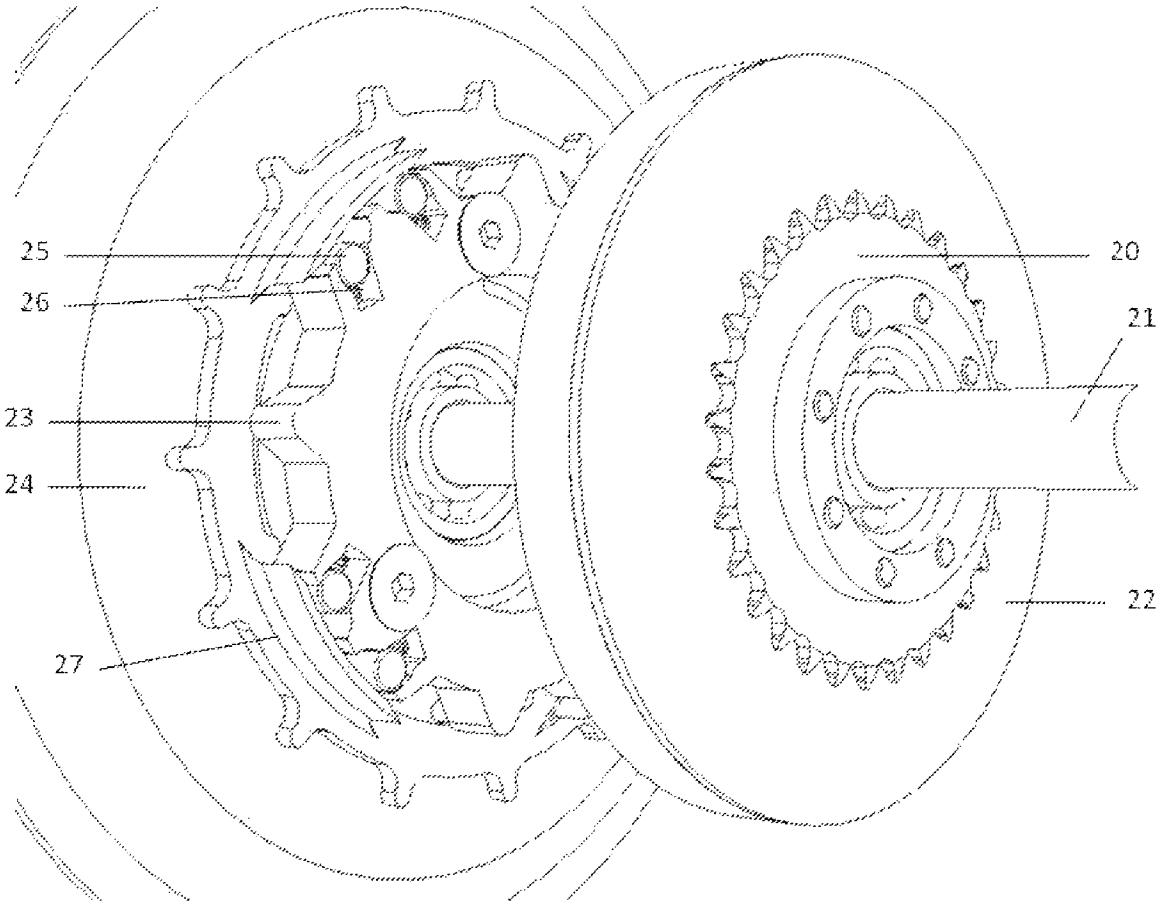
FIG. 6 shows the generator of FIG. 5 in a partial perspective exploded view.

The structure and operation of the adjustable clamping roller coupling of the generator module are described below (see FIGS. 5 and 6) (Note: The connecting element between the outer ring of the coupling and the sprocket is not shown in order to make the parts behind it visible).

When the wire rope hoist is actuated, the sprocket (20) is driven via the rope-chain segment (17) and is seated on the HG axle (21) with ball bearings.

On the side facing the HG, the sprocket is firmly connected coaxially to the coupling outer ring (22).

The outer ring of the coupling is thus driven together with the sprocket directly via the rope-chain segment of the wire rope hoist.

The outer ring of the coupling slips without contact over the clamping roller carrier (23), which is firmly connected to the HG rotor (24) of the generator and is also mounted on the HG axle with ball bearings.

The clamping rollers (25) are mounted between the clamping roller carrier and the coupling outer ring.

The clamping rollers are pressed against the coupling outer ring by compression springs (26), which are located on the clamping roller carrier. As a result, the clamping rollers are carried along by the coupling outer ring when it rotates until they collide with the clamping roller carrier, where they either slip through due to geometric constraints or jam the coupling outer ring with the clamping roller carrier. Due to the geometry of the clamping roller carrier, one half of the clamping rollers jams in a clockwise direction of rotation and the other half in a counterclockwise direction of rotation. However, because the coupling parts should not jam together in both directions of rotation, but should always have a freewheel (overrunning clutch) between the clamping roller carrier and the coupling outer ring, an additional adjusting ring (27) is arranged on the clamping roller carrier on the generator side. This adjusting ring can be set relative to the clamping roller carrier with the aid of an adjusting guide in such a way that either all or at least one half of the clamping rollers are held away from their clamping positions, so that either complete decoupling or, depending on the direction of rotation, freewheeling (overrunning clutch) can be set between the driving coupling outer ring and the output clamping roller carrier.

Figure 7:
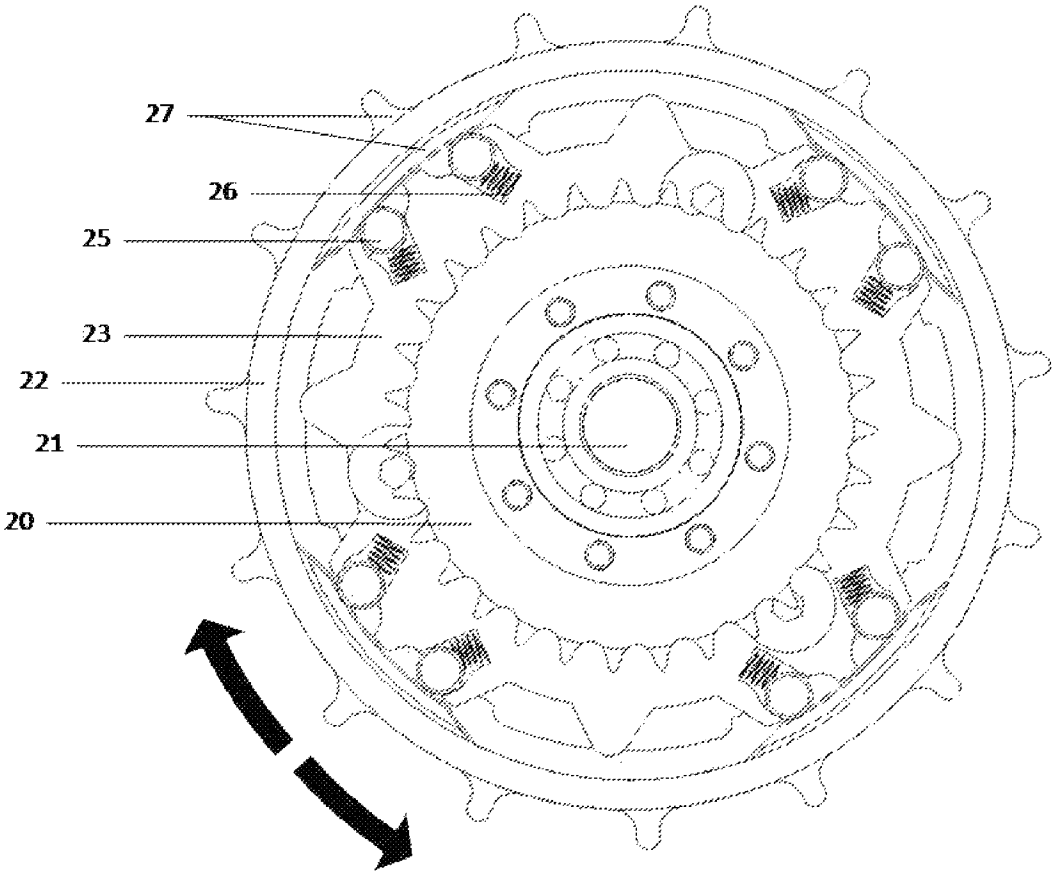
FIG. 7 shows the generator of FIG. 5 in a sectional view in a first functional condition.
Figure 8:
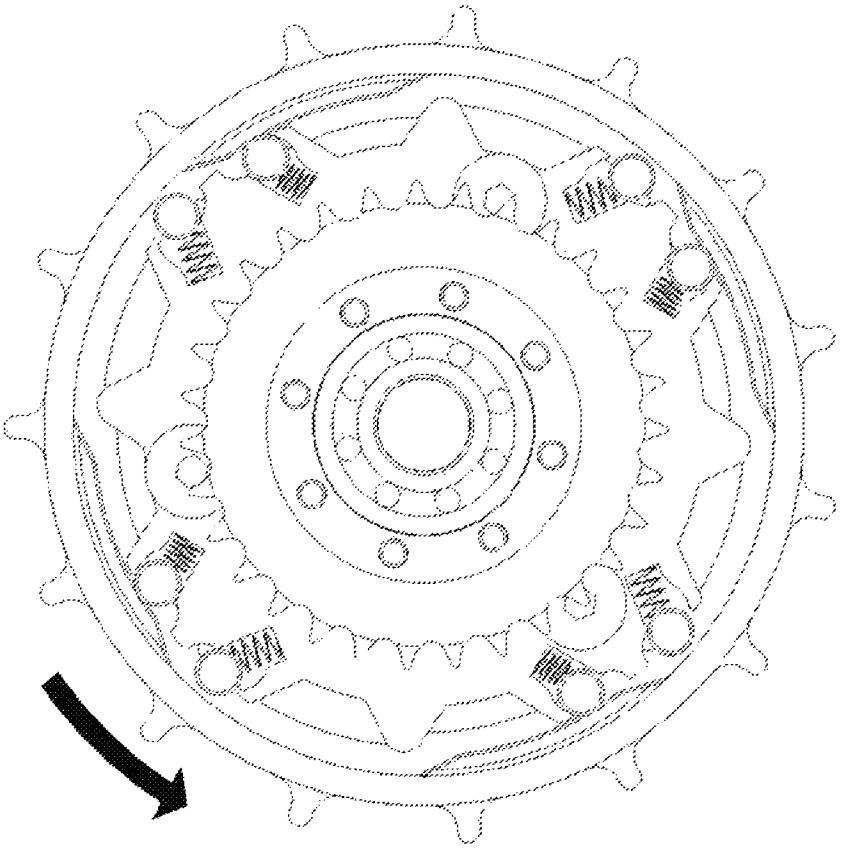
FIG. 8 shows the generator of FIG. 5 in a sectional view in a second functional condition.
Figure 9:
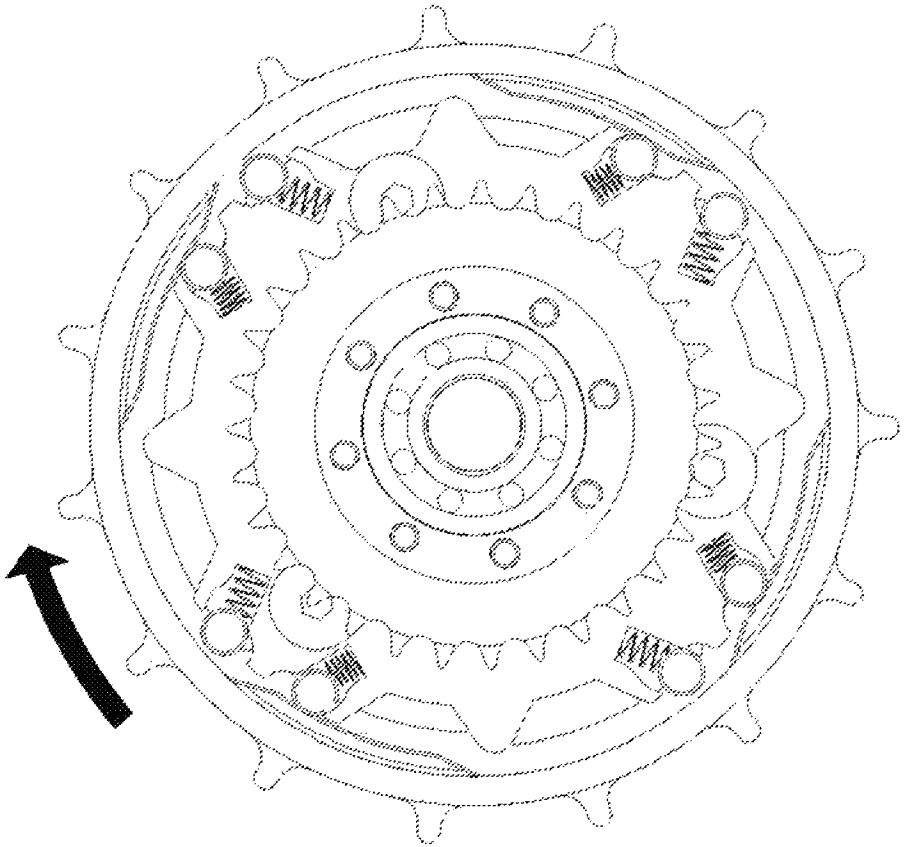
FIG. 9 shows the generator of FIG. 5 in a sectional view in a third functional condition.

Thus, depending on the position of the adjusting ring, three different coupling states can be set, which are described in more detail below:

1. Neutral position: Decoupling and thus independent rotatability between drive and output (see FIG. 7).
2. Freewheeling position 1: Overrunning clutch in clockwise relative direction of rotation between drive and output (see FIG. 9)
3. Freewheeling position 2: Overrunning clutch in counterclockwise relative direction of rotation between drive and output (see FIG. 8)

(Note: The connecting element between the outer ring of the coupling and the sprocket is not shown in FIGS. 7 to 9 in order to make the parts behind it visible).

Functioning of the Neutral Position (See FIG. 7):

In the neutral position of the adjusting ring (27), all the clamping rollers (25) are held back from the clamping positions by the adjusting ring and therefore cannot jam between the coupling outer ring and the clamping roller carrier.

In this setting, there is no direct contact between the clamping rollers and the coupling outer ring (22) and the coupling outer ring is thus decoupled from the clamping roller carrier (23).

The sprocket (20) with the coupling outer ring can be rotated independently of the clamping roller carrier.

(Note: In the figure, the black arrows indicate the uncoupled directions of rotation. The clamping rollers are held back from the clamping positions by the adjusting ring).

Functioning of the Freewheeling Position 1 (See FIG. 9):

If the adjusting ring is rotated clockwise by a few degrees relative to the clamping roller carrier, one half of the clamping rollers is activated and pressed into the clamping positions by the compression springs, while the other half continues to be held back by the adjusting ring.

This creates a freewheel (overrunning clutch) because, due to geometric constraints, the active clamping rollers now jam between the clamping roller carrier and the coupling outer ring in one relative direction of rotation, while they slip in the opposite direction.

(Note: The black arrow indicates the relative direction of rotation of the coupling outer ring with respect to the clamping roller carrier in which the clamping rollers do not jam.

In the case of a relative rotation of the coupling outer ring against the direction of the arrow, the clamping rollers jam the clamping roller carrier with the coupling outer ring).

Functioning of the Freewheeling Position 2 (See FIG. 8):

If the adjusting ring is now rotated in the other direction again, first all the clamping rollers are again pushed away from the clamping positions and brought into neutral position and, on further rotational adjustment, the other half of the clamping rollers is activated and brought into clamping position by the compression springs, which causes a correspondingly opposite freewheeling (overrunning clutch).

(Note: The black arrow indicates the relative direction of rotation of the coupling outer ring with respect to the clamping roller carrier in which the clamping rollers do not jam.

In the case of a relative rotation of the coupling outer ring against the direction of the arrow, the clamping rollers jam the clamping roller carrier with the coupling outer ring).

Relative rotation of the sprocket with respect to the HG rotor is therefore only possible in one relative direction of rotation in each of the two freewheel positions, namely when the respective clamping rollers are driven back by the coupling outer ring in the direction of their compression springs, where they cannot jam due to their geometry and therefore slip.

The sprocket and HG rotor are thus decoupled from each other in this direction of rotation.

In the opposite relative direction of rotation, however, the clamping rollers jam the outer ring of the coupling with the clamping roller carrier and establish a frictional coupling between the sprocket and the HG rotor.

The connection of the wire rope hoist to the generator module by means of the adjustable clamping roller coupling described above and its three coupling states enables three different training modes at the rope pull station:

1. Training with Constant Weight Resistances:

The adjustable clamping roller coupling is in neutral position and thus the sprocket of the wire rope hoist is decoupled from the generator module and can be rotated independently.

In this training mode, rope pull training with constant weight resistances is possible in the same way as on conventional rope pull machines.

This means that a training weight is set on the weight block using a plug-in system and, depending on the setting of the swiveling pulleys and the selected training handles at the ends of the ropes, the weight can be raised and lowered again in various ways.

In this training mode, there is no conversion of energy performed on the wire rope hoist during training. Weights are lifted and returned to their starting point to provide training impulses to the muscles in the conventional way.

2. Training with Constant Weight Resistances and Indirect Conversion of the Physical Energy Performed into Electrical Energy:

In this training mode, the adjustable clamping roller coupling has an overrunning clutch set so that the clamping rollers slip while the preset weight is being lifted by means of the wire rope hoist, and jam while the weight is being lowered again.

This creates a frictional connection between the wire rope hoist and the generator when the weight is lowered, and the lifting energy in the wire rope hoist is transferred to the generator and can be converted into electrical energy.

The electrodynamic resistance created in the generator ensures that the weight stack slides back to its starting position with braking.

The lowering speed of the weight and the extent of the energy conversion can be regulated electronically, for example by pulse width modulation or another electronic device that regulates the current flow or the rotational resistance in the generator. Unlike the first training mode, the set weight stack is lifted in this training mode in the conventional way by physical exertion, but during lowering the weight is braked by the generator module and can thus be returned to its starting position in a controlled manner with less effort.

Because the affected muscles are thus relieved during the return movement and can recover, more power is available to overcome the weight resistance again when the weight is lifted.

As a result, training can be done with greater resistance and a greater training stimulus can be generated.

At the same time, a large part of the training power can be converted and measured and further utilized as electrical energy.

3. Training with Electrodynamic Resistance and Direct Conversion of the Physical Energy Performed into Electrical Energy:

In this training mode, the adjustable clamping roller coupling has an overrunning clutch set so that the clamping rollers jam while a weight stack (minimum return weight) is lifted using the wire rope hoist, and slips while the weight stack is lowered again.

The rotor of the generator is therefore driven directly by the power exerted on the wire rope hoist, and an electrodynamic resistance then arises at the generator as a result of the energy conversion, which becomes greater the stronger the rotor is driven and the more electrical energy is dissipated.

The magnitude of this electrodynamic resistance can be electronically regulated, as in the $2^{nd}$ training mode.

During the return movement, the wire rope hoist is decoupled from the generator by the overrunning clutch.

The clamping rollers slip and the wire rope hoist is returned to its initial position by the weight stack (minimum return weight). Similar to the $2^{nd}$ training mode, the affected muscles are relieved during the return movement and can recover. This means that more power is then available to overcome the dynamic resistance again. As a result, training can be done with greater resistances and a greater training stimulus can be generated.

At the same time, a large part of the training power can be converted and measured and further utilized as electrical energy. In addition to the electrodynamic resistance, additional weight resistance can also be set by setting a larger weight stack (more than the minimum return weight). Overcoming the combination of static and electrodynamic resistance requires a particularly large physical effort. In this way, the affected muscles can be pushed to their performance limits particularly quickly and a correspondingly strong training stimulus can be set.

Thus, in this training mode, the training resistance in the wire rope hoist can be influenced by the speed of the exercise execution, by electronic regulation and by the additional weight resistance selected.

Figure 3:
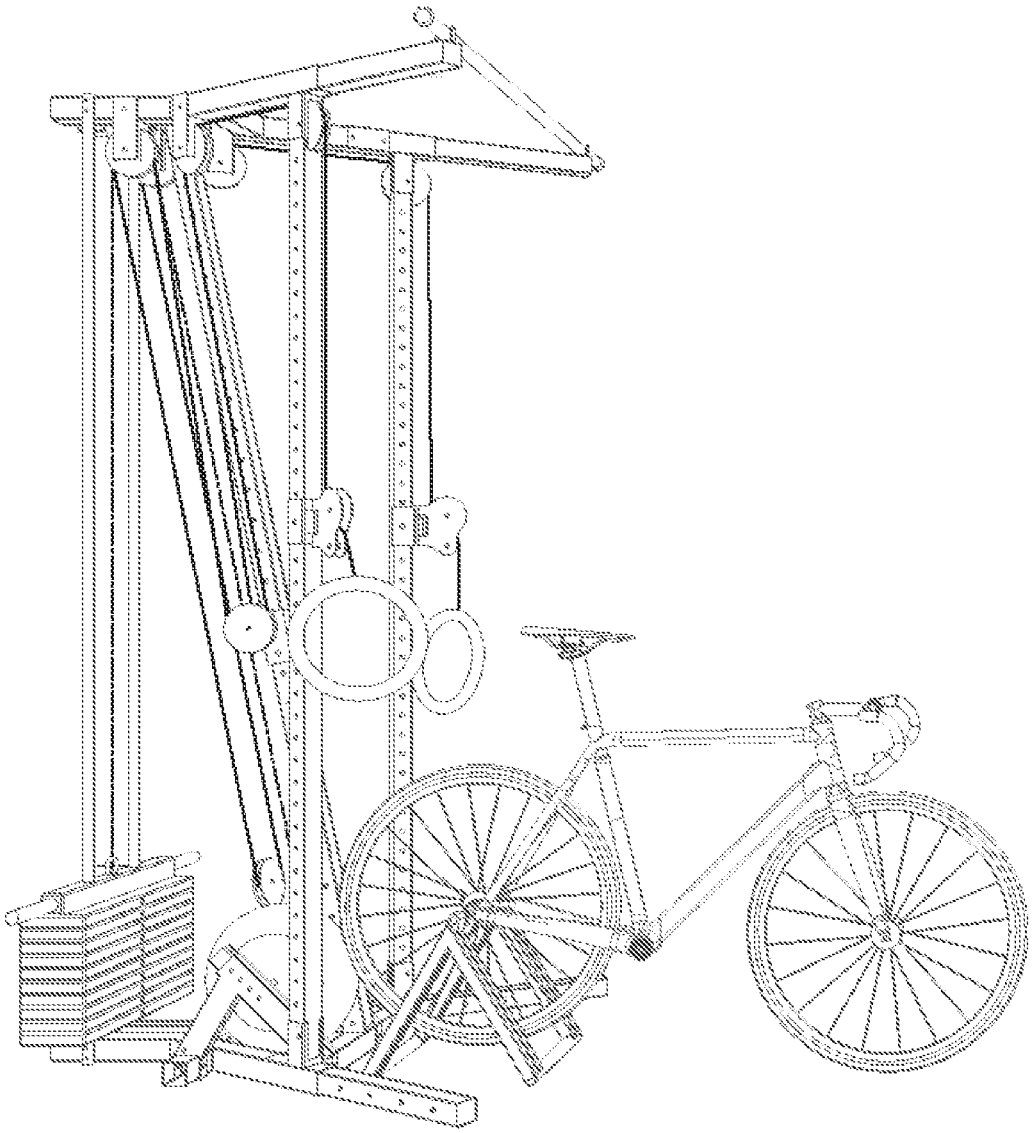
FIG. 3 shows the cable pull machine of FIG. 1 with a bicycle connected to it in a perspective view.
Figure 4:
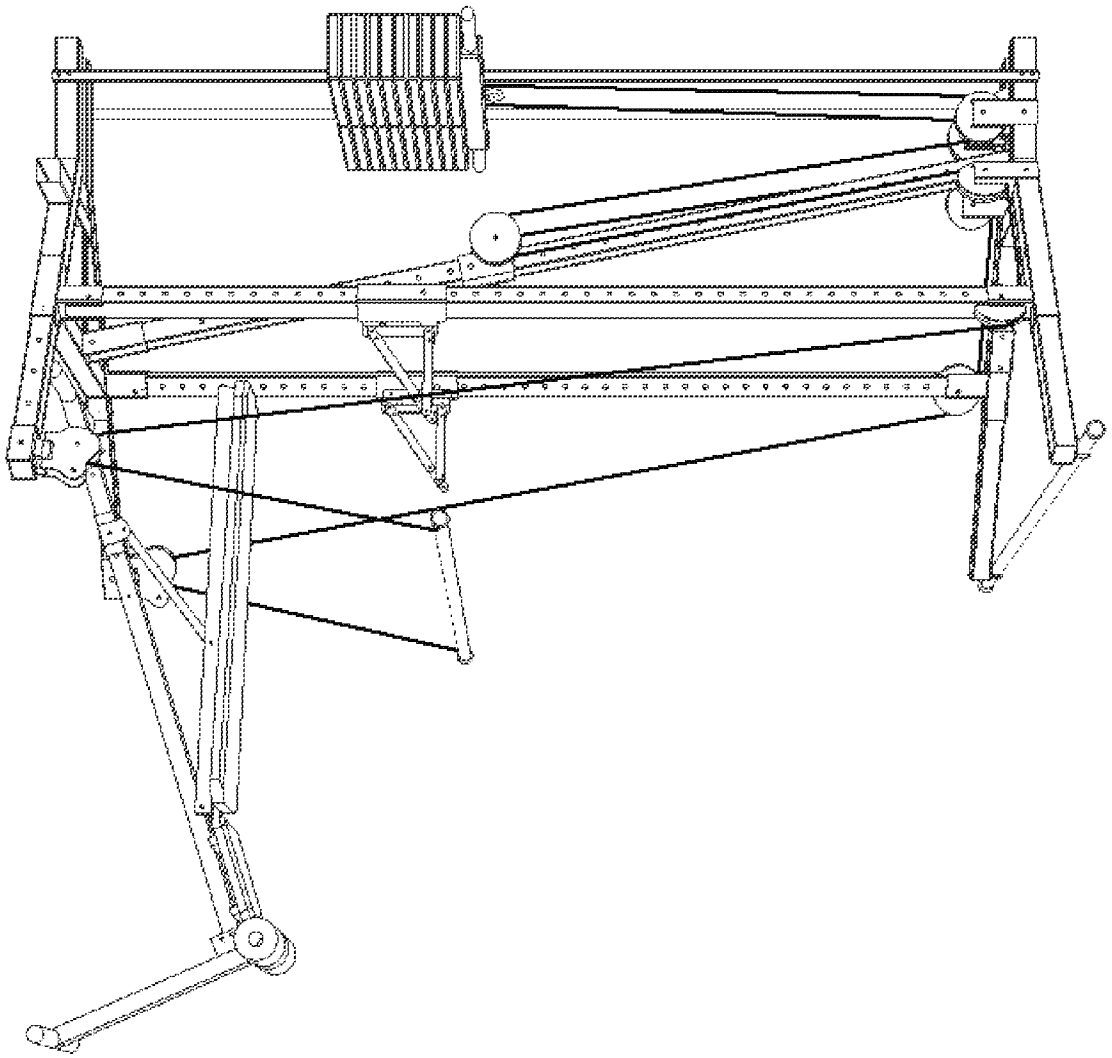
FIG. 4 shows the cable pull machine of FIG. 1 with a bench connected to it in a perspective view.

Another special feature of this fitness machine is that in the neutral position of the clamping roller coupling, an ordinary bicycle can be converted into a stationary bicycle ergometer by connecting it to the generator module. (see FIG. 3) For this purpose, an ordinary bicycle is clamped at its rear wheel axle in a training stand which, with the aid of a further clamping device, is braced with the stand construction of the generator module in such a way that the rear bicycle tire is pressed against the rubber-tired rotor of the hub generator.

In this way, the torque from the pedaling work on the bicycle can be transmitted to the generator module by frictional contact and converted into electrical energy.

The neutral position of the adjustable clamping roller coupling ensures the necessary decoupling from the sprocket of the wire rope hoist. Just as in the $2^{nd}$ and $3^{rd}$ training mode, the magnitude of the electrodynamic resistance can be regulated by means of electronic influence.

A sequence of different resistance intensities can also be used to simulate distance scenarios in this way. The function of the bicycle gears is maintained and can be used as usual to influence the resistance intensity.

Another feature of this fitness machine is the modular composition of the generator module and the rope pull station, which makes it possible to use both module parts independently.

Thus, the rope pull station can be used for strength training like a conventional rope pull machine even without the generator module, and the generator module can also be used as a stand-alone bicycle ergometer in conjunction with a bicycle in a stand.

Another feature is that the HG can be easily disassembled from the generator module, which allows both external use of the HG and uncomplicated equipment maintenance. Mounting rails are attached to the ends of the axle of the HG to resist torsion and bending.

This allows the HG to be simply inserted into the generator stand and bolted to it. Thanks to the ease of dismantling and the connected mounting rails, the rubber-tired hub generator can also be removed if necessary and used as a drive module for various electric vehicle concepts.

The attached adjustable clamping roller coupling also makes chain operation possible as an option.

In this way, the components available on the fitness machine and the electrical energy generated on it itself could be used to increase energy sufficiency and resource utilization.

Figure 10:
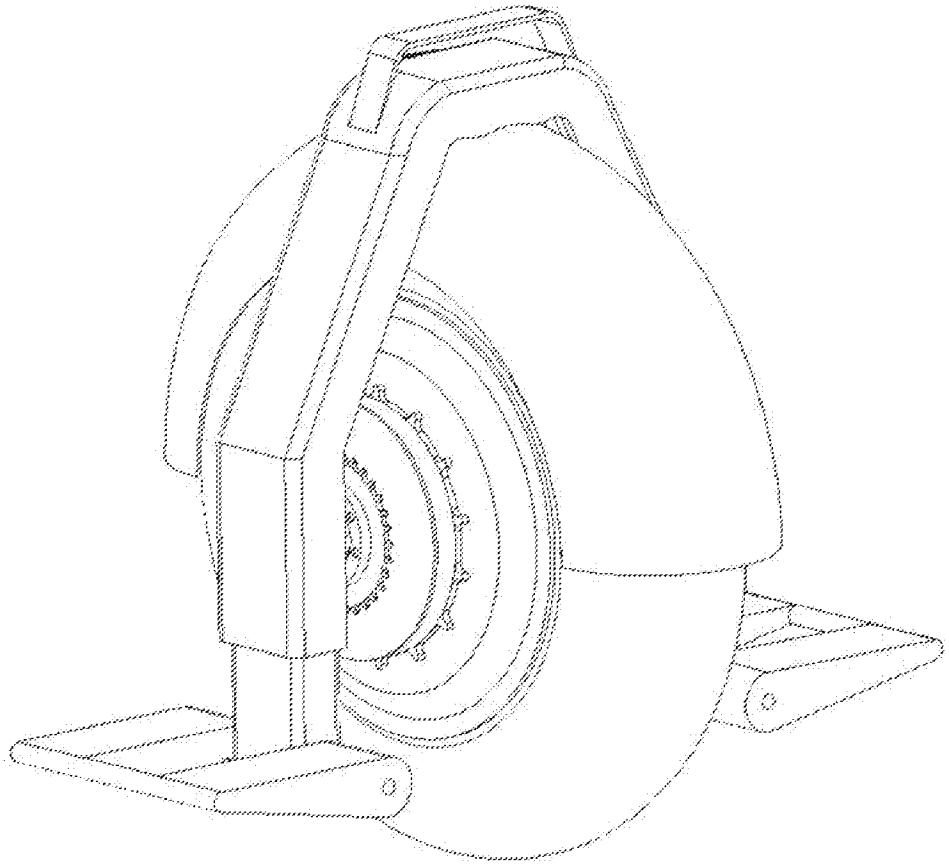
FIG. 10 shows an alternative generator in the cable pull machine of FIG. 1 in a perspective view.

As an example, the use as an electric, self-balancing unicycle is outlined here. (see FIG. 10)

Another special feature of this fitness machine is that the energy generated by muscle power can be measured and further utilized by converting it into electrical energy. This means that training performance can be digitally recorded and visualized and evaluated by means of applications.

By creating digital profiles on networked servers, a user could view their performance data at any time and train individually anywhere on such a fitness machine according to their performance and individual training plan. Interactive applications with entertainment or competition character and the generated energy could motivate the user to continuously perform, which could contribute to an increase in physical fitness and a more energy-sufficient lifestyle.

Inventive Benefit

The combination of a rope pull station and generator module by means of an adjustable clamping roller coupling results in a fitness machine with a wide range of training possibilities.

All exercise variations on the wire rope hoist can be performed with adjustable, constant weight resistances as well as with adjustable, electrodynamic resistances. Ordinary bicycles can be connected to the generator module mounted in an upright position and thus converted into stationary bicycle ergometers.

If necessary, the rubber-tired hub generator of the generator module can be detached from its holder in just a few steps and used, for example, as a drive module for various electromobility vehicle concepts.

The physical work performed during training can be converted directly or indirectly into electrical energy.

The physically generated energy can be measured and the training performance evaluated.

The fitness machine offers a new approach for the development of interactive, intelligent, networked and entertaining applications for the evaluation and visualization of training performance achieved, for increasing individual performance and for supporting a more energy-sufficient lifestyle.

The disclosure relates to a fitness machine comprising a rope pull station and a generator module with an adjustable clamping roller coupling which, according to its setting, enables the training power performed on the machine by muscle power to be transmitted to the generator module in such a way that the physical work performed can be converted directly or indirectly into electrical energy and further utilized, which can serve the exerciser on the one hand as a means of measuring and increasing his physical performance and on the other hand as a means of autonomous energy supply.

In a particular embodiment, depending on the setting of the adjustable clamping roller coupling, the fitness machine can provide three different training modes, namely training with constant weight resistances, training with constant weight resistances and indirect conversion of the physical work performed into electrical energy, and training with electrodynamic resistances and direct conversion of the physical work performed into electrical energy.

In a particular embodiment, the power transmission between the rope pull station and the generator module can be decoupled with using the neutral position of the adjustable clamping roller coupling, so that conventional use of the wire rope hoist is also possible.

In a particular embodiment, the frame of the rope pull machine can comprise a triangular foot and head construction, two vertical front supports, two vertical rear weight guide rods, a support mounted at an angle between the front foot and rear head construction, and two cantilever arms each extendable in a v-shape from the foot and head construction, the two cantilever arms of the head construction having two fork bearings in which a barbell rod can be clamped for high-bar exercises.

In a particular embodiment, the weight block can additionally have weight plate receptacles, with which the weight load can be finely regulated and expanded.

In a particular embodiment, the rope ends of the wire rope hoist can be deflected by means of swiveable, adjustable pulleys both along the cantilever arms and along the vertical supports at regular hole distances by means of plug-in systems, and the free length of the rope ends can be adjusted by deflecting the wire rope hoist by means of an adjustable pair of pulleys along the inclined central support.

In a particular embodiment, a collapsible weight bench can be suspended from the frame construction without restricting the operability of the machine.

In a particular embodiment, the fitness machine can be equipped with swiveable and adjustable support devices that can be used as dumbbell rests for barbell exercises, as support bars for planks, or as step-ups.

In a particular embodiment, a bicycle training stand can be connected to the generator module, which enables stationary bicycle training with ordinary bicycles in that the pedaling work on the bicycle can be transferred from its rear wheel axle to the generator module by frictional connection and converted into electrical energy, and the oppositely directed electrodynamic rotational resistance of the generator can be influenced by electronic regulation of the current flow.

In a particular embodiment, the rubber-tired hub generator of the generator module can be detached from its mounting as required and used as a drive module for various electromobility vehicle concepts with or without an additional chain drive.

In a particular embodiment, the fitness machine can enable the further utilization of physically generated energy by converting it into electrical energy and thereby making it measurable, evaluable and further usable, thus also enabling the integration of digital applications.

Furthermore, the disclosure relates to an adjustable clamping roller coupling with which, by appropriate adjustment, either a decoupling in both relative directions of rotation, or an overrunning clutch (clamping roller coupling) in clockwise relative direction of rotation, or an overrunning clutch (clamping roller coupling) in counterclockwise relative direction of rotation can be produced between two coaxially arranged, independently rotatable components, characterized in that a. it comprises a shaft with a coupling outer ring, a connecting shaft with a clamping roller carrier, clamping rollers, compression springs and a changeover ring.
b. the clamping roller carrier is designed in such a way that, depending on the direction of relative rotation, the active clamping rollers either slip through as a result of geometric constraints or jam with the coupling outer ring slipped over them, thus producing a torque transmission between the two coupling parts.
c. in the case of the overrunning clutches, torque transmission by jamming exists in each case only in the one relative direction of rotation, while freewheeling exists in the respective opposite relative direction of rotation.
d. the adjusting ring, depending on its setting, keeps either all or at least one half of the clamping rollers away from the positions where the clamping rollers could jam the coupling outer ring with the clamping roller carrier.

The invention claimed is:

1. A cable pull station for providing a defined resistance force for resistance training comprising a weight (9), which is arranged movably using a pulling element (7, 17) and on which the resistance force is at least dependent, the pulling element (7, 17) being guided via at least one coupling roller (18), which is designed to transfer the linear motion of the pulling element as a rotary motion to a generator (19) to generate electrical energy, wherein the coupling roller (18) is designed as a-clamping roller coupling, and the clamping roller coupling comprises first clamping rollers (25) for transmitting a movement of the pulling element (7, 17) to the generator (19) in a first direction, second clamping rollers for transmitting a movement of the pulling element (7, 17) to the generator (19) in a second direction opposite to the first direction, and an adjusting element (27), wherein the adjusting element (27) is an additional adjusting ring (27) that is arranged on a clamping roller carrier on a generator side; and the adjusting ring (27) is configured to be set relative to the clamping roller carrier with an aid of an adjusting guide in such a way that either all or at least one half of the clamping rollers are held away from clamping positions, so that either complete decoupling or, depending on a direction of rotation, freewheeling can be set between a driving coupling outer ring and an output of the clamping roller carrier.

2. The cable pull station according to claim 1, wherein the cable pull station is configured to generate and optionally display information dependent on the electrical energy generated.

3. The cable pull station according to claim 2, wherein the cable pull station is configured to store the generated information in a data store.

4. The cable pull station according to claim 2, comprising a connector for connecting the piece of sports equipment to the generator.

5. The cable pull station according to claim 3, comprising a connector for connecting the piece of sports equipment to the generator.

6. The cable pull station according to claim 1, comprising a connector for connecting a piece of sports equipment to the generator.

7. The cable pull station according to claim 6, wherein the piece of sports equipment is a bicycle and the connector is designed to establish a friction gear connection between the generator and a drivable wheel of the bicycle.

8. The cable pull station according to claim 1, wherein the pulling element (7, 17) is designed as a rope-chain segment (17).

9. The cable pull station according to claim 6, comprising a connector for connecting the piece of sports equipment to the generator.

10. A cable pull station for providing a defined resistance force for resistance training comprising a weight (9), which is arranged movably using a pulling element (7, 17) and on which the resistance force is at least dependent, the pulling element (7, 17) being guided via at least one coupling roller (18), which is designed to transfer the linear motion of the pulling element as a rotary motion to a generator (19) to generate electrical energy;

wherein the coupling roller (18) is designed as a freewheel;

wherein the freewheel is designed as a clamping roller coupling; and wherein the clamping roller coupling comprises first clamping rollers (25) for transmitting a movement of the pulling element (7, 17) to the generator (19) in a first direction, second clamping rollers for transmitting a movement of the pulling element (7, 17) to the generator (19) in a second direction opposite to the first direction, and an adjusting element (27), wherein the adjusting element (27) is an additional adjusting ring (27) that is arranged on a clamping roller carrier on a generator side; and the adjusting ring (27) is configured to be set relative to the clamping roller carrier with an aid of an adjusting guide in such a way that either all or at least one half of the clamping rollers are held away from clamping positions, so that either complete decoupling or, depending on a direction of rotation, freewheeling can be set between a driving coupling outer ring and an output of the clamping roller carrier.

11. The cable pull station according to claim 8, wherein the adjusting element (27) is arranged to press the first clamping rollers (25) and the second clamping rollers, respectively, radially inward.

12. The cable pull station according to claim 11, comprising a connector for connecting the piece of sports equipment to the generator.

13. The cable pull station according to claim 10, comprising a connector for connecting the piece of sports equipment to the generator.

14. The cable pull station according to claim 8, wherein the pulling element (7, 17) is designed as a rope-chain segment (17).

* * * * *